US007712310B2

(12) United States Patent
Lin

(10) Patent No.: US 7,712,310 B2
(45) Date of Patent: May 11, 2010

(54) DOUBLE POWER STIRLING ENGINE AND COAXIAL STIRLING POWER MECHANISM

(76) Inventor: Pao-Lung Lin, 10F, No.512, Sec. 2, Cheng Kung Rd., Taipei (TW)

( * ) Notice: Subject to any disclaimer, the term of this patent is extended or adjusted under 35 U.S.C. 154(b) by 135 days.

(21) Appl. No.: 12/127,107

(22) Filed: May 27, 2008

(65) Prior Publication Data

US 2008/0295684 A1 Dec. 4, 2008

(30) Foreign Application Priority Data

May 30, 2007 (TW) ..... 96208853 U

(51) Int. Cl.
*F01B 29/10* (2006.01)

(52) U.S. Cl. ..... 60/517; 60/525

(58) Field of Classification Search ..... 60/517, 60/525

See application file for complete search history.

(56) References Cited

U.S. PATENT DOCUMENTS 2,558,481 A * 6/1951 Dros ..... 62/6
3,302,393 A * 2/1967 August et al. ..... 60/525
3,492,813 A * 2/1970 Meijer ..... 60/525
3,559,398 A * 2/1971 Meijer et al. ..... 60/521
4,020,635 A * 5/1977 Joynes et al. ..... 60/525

* cited by examiner

*Primary Examiner*—Hoang M Nguyen
(74) *Attorney, Agent, or Firm*—Chun-Ming Shih

(57) ABSTRACT

A Stirling engine includes a piston seat, a displacer arranged in the piston seat, a piston seat, and a push rod. Meanwhile, a piston tube is arranged on the piston seat and an airtight piston is arranged in the piston tube. Moreover, one end of the push rod is connected to the displacer, while another end passes through the airtight piston and extends out of the piston seat. Additionally, a power mechanism includes the aforementioned Stirling engine, a crankshaft, an axle seat pivoted with the crankshaft, and two pairs of first and second swing arms that are respectively connected from the crankshaft to the top ends of the push rod and the airtight piston and are arranged symmetrically to each other.

11 Claims, 8 Drawing Sheets

DOUBLE POWER STIRLING ENGINE AND COAXIAL STIRLING POWER MECHANISM

BACKGROUND OF THE INVENTION

1. Field of the Invention

The present invention generally relates to a heat engine converting thermal energy into kinetic energy, in particular, to a displacer type Stirling engine having double power output.

2. Description of Prior Art

Basically, Stirling engine is an external combustion engine with a reciprocating motion. A typical Stirling engine mainly includes two cylinders: one cylinder is heated by an externally heating source, while another cylinder is cooled by an externally cooling source. The two cylinders are communicated in a way, such that gas in the cylinders can be pushed to flow between two cylinders by means of a piston motion activated in the cylinders and then outputs external work through some mechanisms, such as connecting rod, crank, flywheel, etc, arranged between the two cylinders.

Besides the aforementioned "double cylinder" type, a "displacer" type is another kind of Stirling engine. The "displacer" type Stirling engine integrates the aforementioned two cylinders into one big cylinder, a bottom of which is designed as a heating position, and a top of which is designed as a cooling position. A displacer arranged in the big cylinder is not airtight and can be displaced upwardly and downwardly, making gas moved freely in the big cylinder. In addition, a smaller airtight piston (or so-called "power piston") is arranged at a top of the big cylinder, when the displacer in the big cylinder is activated, because of an expansion and shrink of the gas in the big cylinder, the power piston can be displaced upwardly and downwardly to output work externally.

However, due to one big cylinder, conventional displacer type Stirling engine performs poorly as compared to the double cylinder type having double power output. Even having a double power output, the work made by the conventional double cylinder type Stirling engine is easily deteriorated because two powers respectively outputted from two cylinders that are not coaxial are unbalanced, and a runout phenomenon will occur.

Accordingly, aiming to solving the aforementioned shortcomings, after a substantially devoted study, in cooperation with the application of relatively academic principles, the inventor has at last proposed the present invention that is designed reasonably to possess the capability to improve the prior arts significantly.

SUMMARY OF THE INVENTION

The invention is mainly to provide a double power Stirling engine and a coaxial Stirling power mechanism, which can improve the performance of the conventional displacer type Stirling engine, owing to a capability of double power output. In the meantime, since the double power output is generated coaxially, the driven mechanism uneasily generates a runout motion associated to the activation, and thus the made work is uneasily deteriorated.

Secondly, the invention is to provide a double power Stirling engine, including a piston seat having a hollow chamber therein, a displacer arranged in the chamber, a piston seat, and a push rod. According to the invention, a piston tube arranged on the piston seat internally has an airtight passage communicated to the chamber, and an airtight piston is arranged in the airtight passage. Meanwhile, one end of the push rod is connected to the displacer, while another end actively passes through the airtight piston and extends out of the piston seat. Thus, a double power may be output through the airtight piston and the push rod.

Thirdly, the invention is to provide a coaxial Stirling power mechanism, including an aforementioned Stirling engine, a crankshaft, an axial seat pivoted to the crankshaft, a pair of first swing arms, a pair of second swing arms, two coaxially pivoting ends included by the crankshaft, a connecting rod located between two pivoting ends and shown eccentric configuration, two cranks respectively arranged between the connecting rod and the two axial ends, two first pivoting parts respectively arranged between the connecting rod and the two cranks, and two second pivoting parts respectively arranged between the crank and the pivoting end. According to the invention, the first and second pivoting parts are all arranged eccentrically with respect to the two pivoting ends, making the pair of first swing arms respectively arranged between the push rod and the two first pivoting parts, and making the pair of second swing arms respectively arranged between the airtight cylinder and the two second pivoting parts. In the meantime, the pairs of the first and second swing rods are arranged symmetrically. Thus, the aforementioned objectives are achieved.

BRIEF DESCRIPTION OF DRAWING

The features of the invention believed to be novel are set forth with particularity in the appended claims. The invention itself, however, may be best understood by reference to the following detailed description of the invention, which describes a number of exemplary embodiments of the invention, taken in conjunction with the accompanying drawings, in which:

DETAILED DESCRIPTION OF THE INVENTION

In cooperation with attached drawings, the technical contents and detailed description of the present invention are described thereinafter according to a number of preferable embodiments, being not used to limit its executing scope. Any equivalent variation and modification made according to appended claims is all covered by the claims claimed by the present invention.

Figure 1:
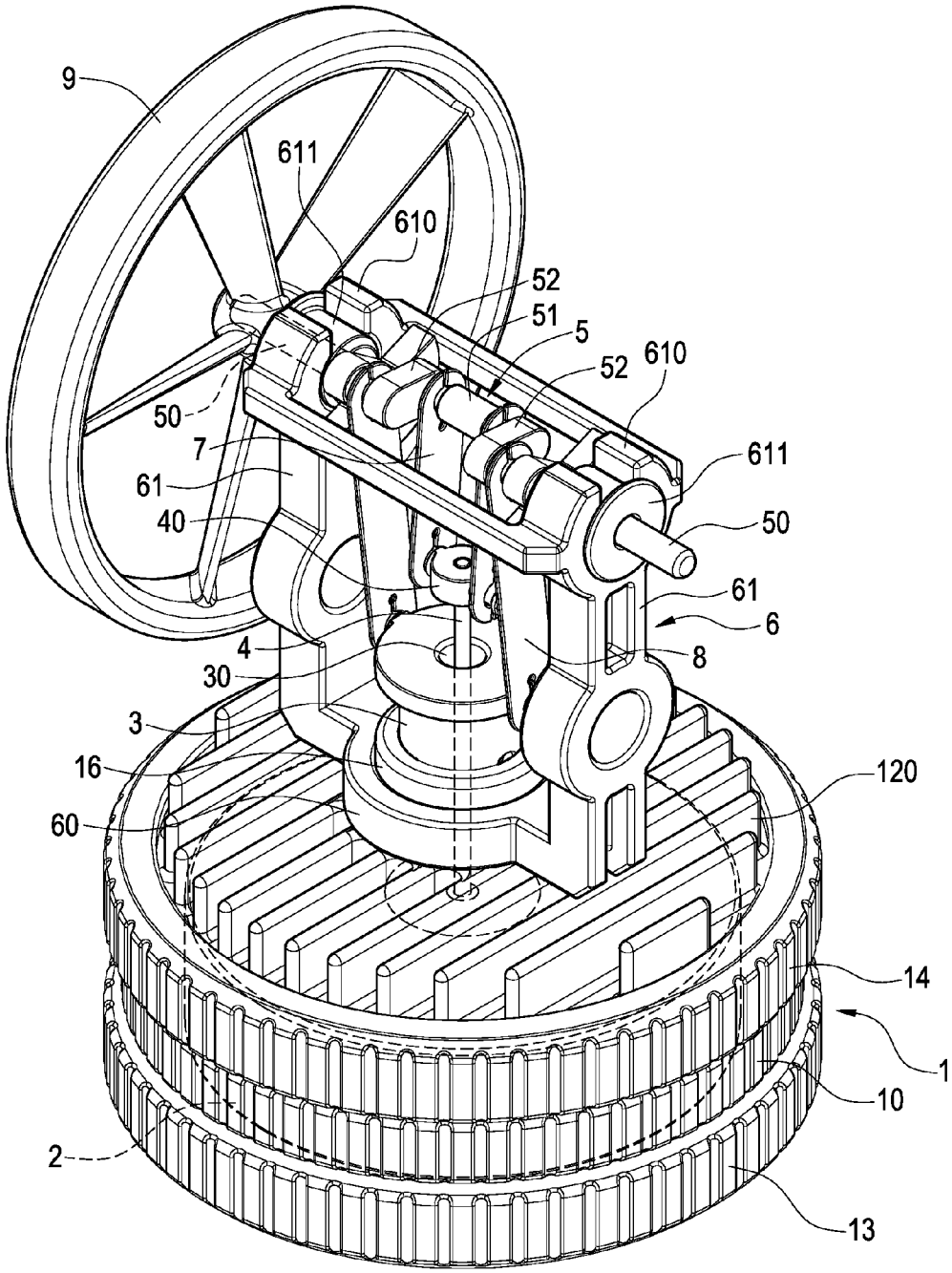
FIG. 1 is a perspective outer appearance view of the first preferable embodiment according to the present invention.
Figure 2:
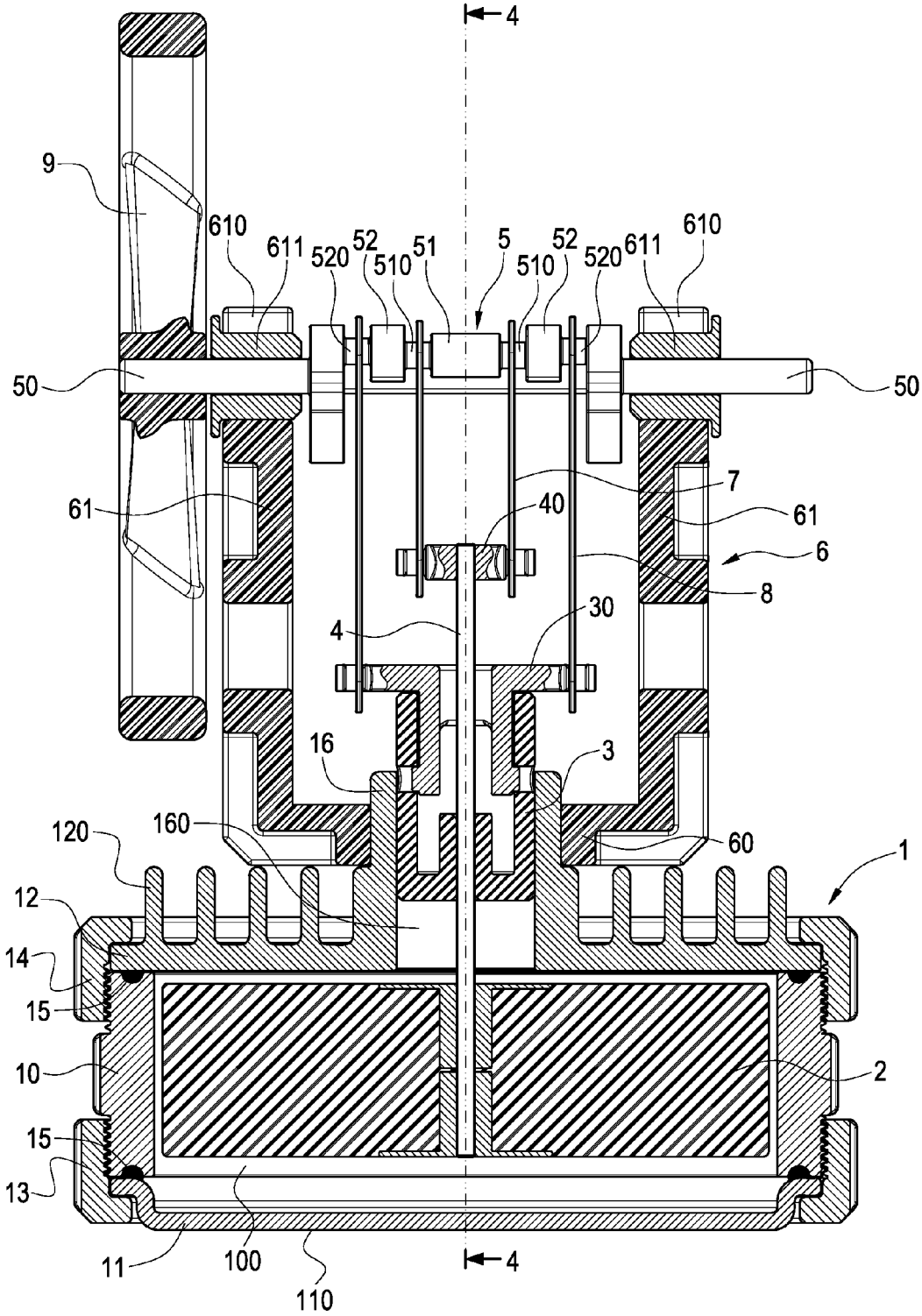
FIG. 2 is a plane sectional view of the first preferable embodiment according to the present invention.

Please refer to FIG. 1 and FIG. 2, which respectively are a perspective outer appearance view and a plane sectional view of the first preferable embodiment according to the present invention. The invention is to provide a double power Stirling engine and a coaxial Stirling power mechanism. The double power Stirling engine mainly includes a piston seat 1, a displacer 2, an airtight piston 3, and a push rod 4.

In this case, the piston seat 1 includes a main body 10, a bottom plate 11, a top plate 12, and two ring lids 13, 14. The main body 10 is configured as a hollow structure, which is communicated to an upper and a lower side opening. Meanwhile, the bottom and top plates 11, 12 respectively cover on the upper and lower side openings, between which a sealing washer is arranged. Under this condition, a hollow chamber 100 is formed in the piston seat 1 through the combination among the bottom and top plates 11, 12 and the main body 10 to provide the aforementioned displacer 2 to be accommodated in the chamber 100. In addition, the two ring lids 13, 14 are respectively arranged to cover the bottom and top plates 11, 12 for further tightly connecting the bottom and top plates 11, 12 to the main body 10 by means of screw and bolt for example, making the interior of the chamber shown as a sealing state.

Following the aforementioned description, a heated face 110 is arranged under the bottom plate 11 of the piston seat 10. Restated, the heated face 110 is located at an external side of the piston seat 10, for example, a bottom face. Moreover, a plurality of cooling fins 120 extended outward the piston seat 10 are arranged on the top plate 12, on which a piston tube 16 is further arranged. The piston tube 16 is a hollow structure and has an airtight passage 160 that is communicated to the chamber 100 in a way, such that the airtight piston 3 can be cooperated with the airtight passage 160 and mobile therein.

In this case, the push rod 4 is connected to the displacer 2 and passes through the airtight piston 3 for a convenience that, when the displacer 2 is activated, not only the airtight piston 3 can be pushed to do work, but also the push rod 4 can be driven to do work simultaneously, making the Stirling engine possess a capability of double power output. The push rod 4 is configured as a long rod, one side of which is connected to the displacer 2, and another side of which is extended toward the airtight passage 160, passes through the airtight piston 3, and is freely extended out of the piston seat 1. Accordingly, when the heated face 110 arranged under the piston seat 1 is heated by an externally heating source, most gas in the chamber 100 will be thermally expanded, making the gaseous pressure in the chamber 100 boosted to drive the displacer 2 moved upwardly in the chamber 100. Thereby, the push rod 4 is driven to do work; i.e. a power is output. In the meantime, when the displacer 2 is activated upwardly, the airtight piston 3 will be pushed simultaneously to move upwardly in the airtight passage 160 to do work as well, which is another power output. Therefore, a double power Stirling engine according to the invention possesses a capability of double power output through the works made by the airtight piston 3 and the push rod 4 passing through the airtight piston 3.

Therefore, according to the aforementioned structural composition, a double power Stirling engine of the invention is thereby obtained.

Again, please refer to FIG. 1 and FIG. 2 together. The invention is further to provide a coaxial Stirling power mechanism, except the aforementioned double power Stirling engine, further including a crankshaft 5, an axial seat 6, a pair of first swing arms 7, and a pair of second swing arms 8.

Figure 3:
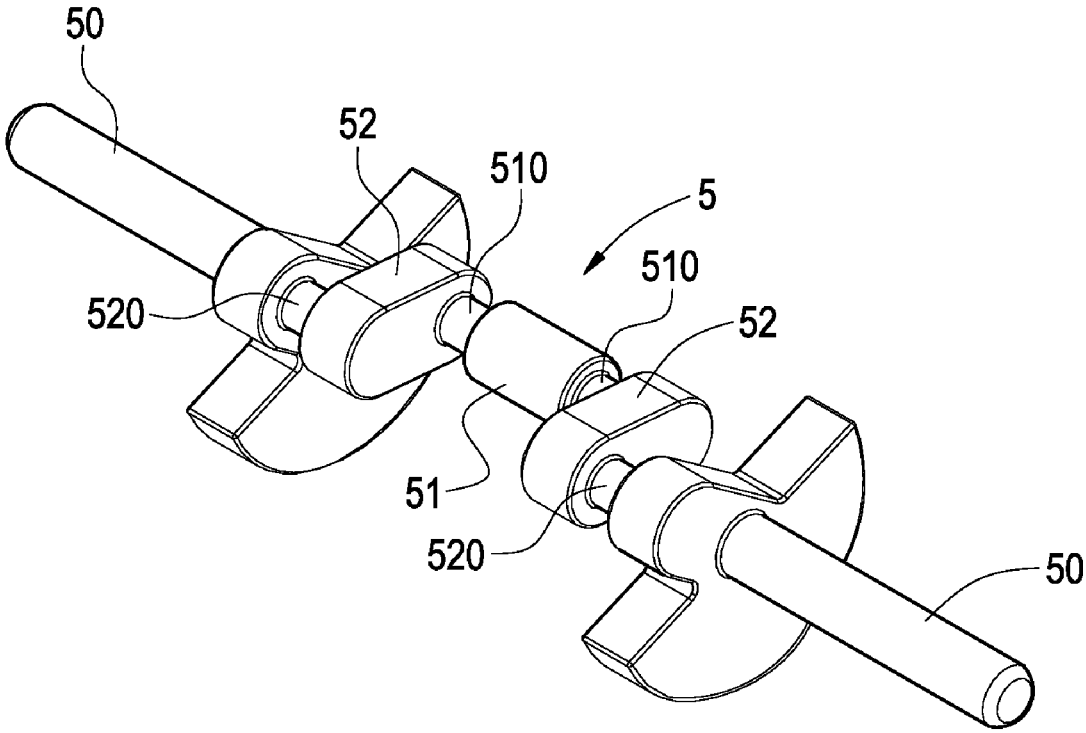
FIG. 3 is a perspective outer appearance view of the crankshaft of the invention.

First of all, please refer to FIG. 3. The crankshaft 5 includes two coaxial pivot ends 50, an eccentric connecting rod 51 arranged between the two pivot ends 50, two cranks 52 respectively arranged between the connecting rod 51 and the two pivot ends 50, two first pivoting parts 510 respectively arranged between the connecting rod 51 and the two cranks 52, and two second pivoting parts 520 respectively arranged between the two cranks 52 and the two pivot ends 50. In this case, the first and second pivoting parts 510, 520 are all arranged eccentrically with respect to the pivot ends 50.

Please refer to FIG. 1, FIG. 2, and FIG. 3 together. The crankshaft 5 is pivoted to the axial seat 6, which is substantially configured as a "U" shape and has a ringed bottom 60 to be fitted onto the piston tube 16 of the aforementioned Stirling engine. Two arms 61 are respectively extended upwardly from two corresponding ends of the bottom 60 and respectively form a bearing part 610 at each top end. An axial sleeve 611 is arranged in each bearing part 610, making two pivot ends 50 of the crankshaft 5 respectively pivoted to the two axial sleeves 611 when the crankshaft 5 is placed horizontally between the two top ends of the two arms 61. In addition, the airtight piston 3 and the push rod 4 of the aforementioned Stirling engine are extended outwardly between the two arms 61, but are located under the crankshaft 5. In this case, a first pivoting seat 40 is arranged at a top end of the push rod 4, while the first pivoting seat 40 and the first pivoting parts 510 of the crankshaft 5 are connected and actively transmitted by the aforementioned first swing arms 7. On the other hand, a second pivoting seat 30 is also arranged at a top end of the airtight piston 3, while the second pivoting seat 30 and the second pivoting parts 520 of the crankshaft 5 are connected and actively transmitted by the aforementioned second swing arms 8. In this case, each pair of the first and second swing arms 7, 8 is arranged symmetrically.

Therefore, according to the aforementioned structural composition, a coaxial Stirling power mechanism of the invention is thereby obtained.

Figure 4:
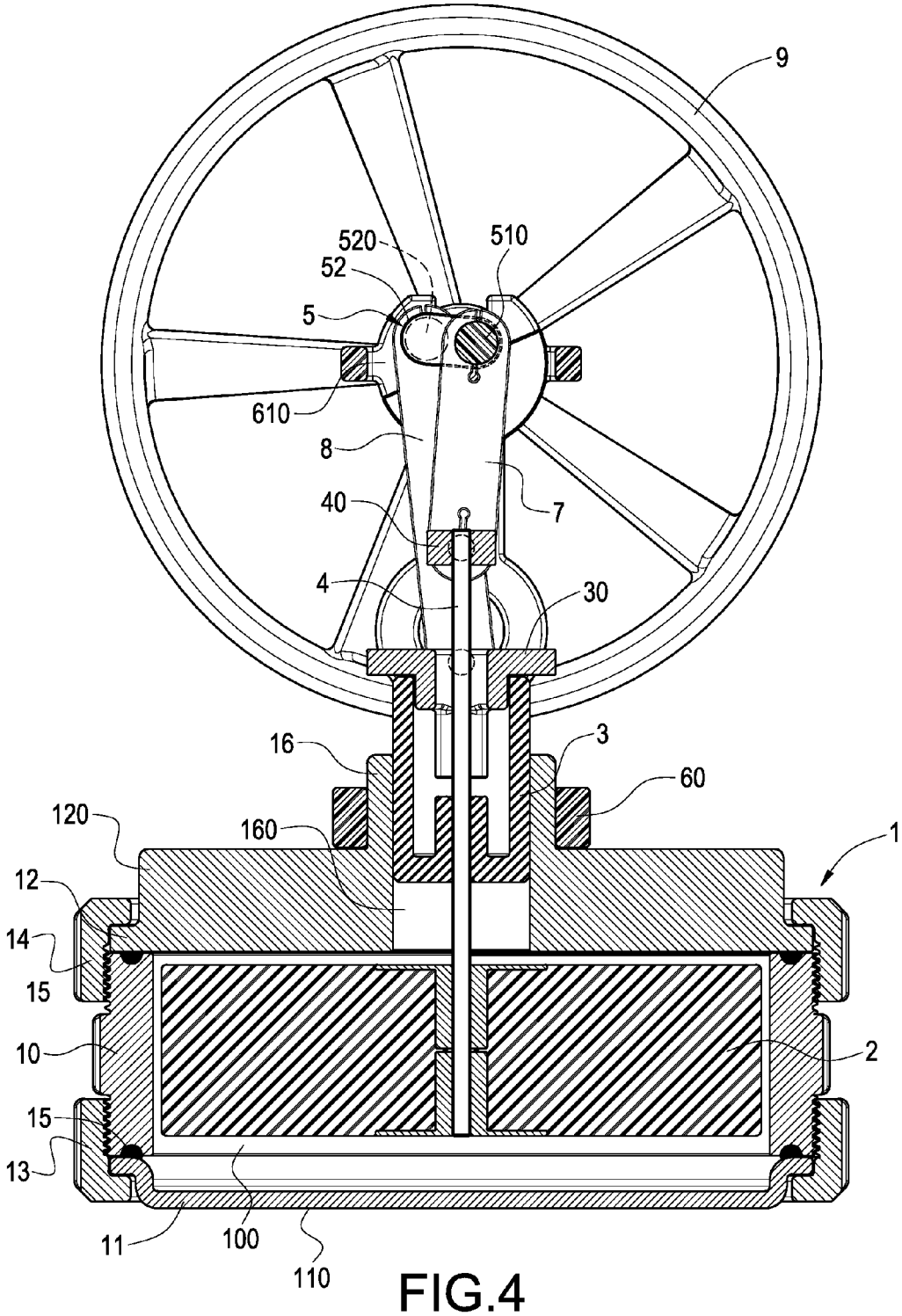
FIG. 4 is a cross-sectional view according to the "4-4" sectional line of FIG. 2.
Figure 5:
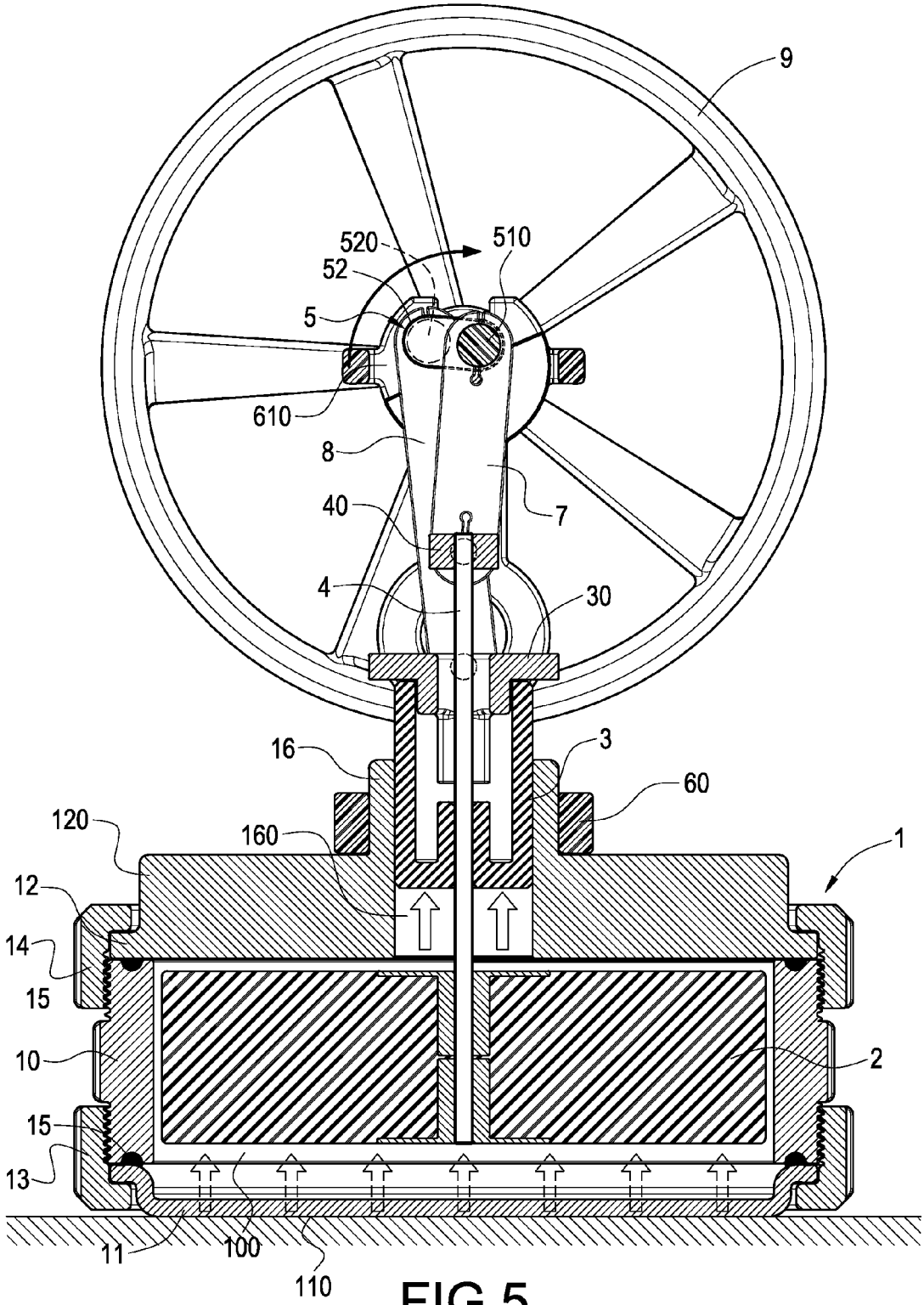
FIG. 5 is an active illustration (1) based on FIG. 2.
Figure 6:
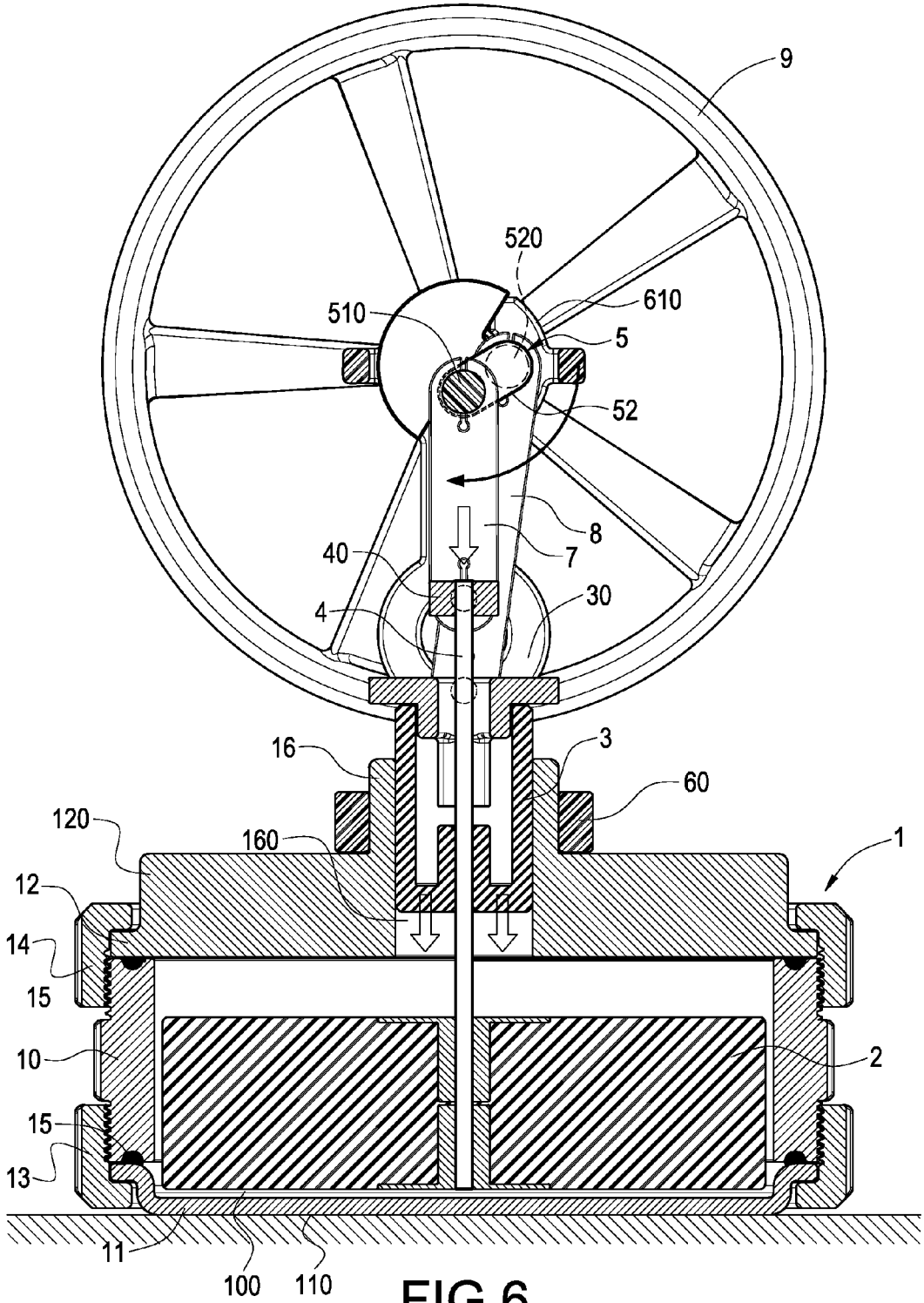
FIG. 6 is an active illustration (2) based on FIG. 2.

Accordingly, as shown in FIG. 4, when the Stirling engine is started to actuate, the push rod 4 and the airtight piston then respectively drive the aforementioned first and second swing arms 7, 8, which subsequently bring along the crankshaft 5 to rotate. As shown in FIG. 5, following the aforementioned description, when the heated face 110 arranged under the piston seat 1 is heated by an externally heating source, the gas in the chamber 100 will be thermally expanded to push the displacer 2 moved upwardly, which in turn makes the push rod 4 move the first pivoting seat 40 upwardly, then the first swing arms 7 will drive the crankshaft 5 to rotate. On the other hand, when the displacer 2 is pushed to move upwardly, the airtight piston 3 will be pushed upwardly simultaneously, so the second swing arms 8 can also drive the crankshaft 5 to rotate. Again, as shown in FIG. 6, after most gas in the chamber 100 is flown to the top plate 12 and cooled by the cooling fins 120, the displacer 2 and the airtight piston 3 will be lowered down, because the gaseous pressure in the chamber 100 is reduced, caused by the shrunk and cool gas. Under such repetitious cycles, the crankshaft 5 can be rotated continuously by means of the swing motions generated by the first and second swing arms 7, 8. Since the first and second swing arms 7, 8 are simultaneously pushed by the displacer 2 and are arranged symmetrically, a smoother motion with less runout can be created. Meanwhile, the works done by the double power Stirling engine are also uneasily deteriorated.

Figure 7:
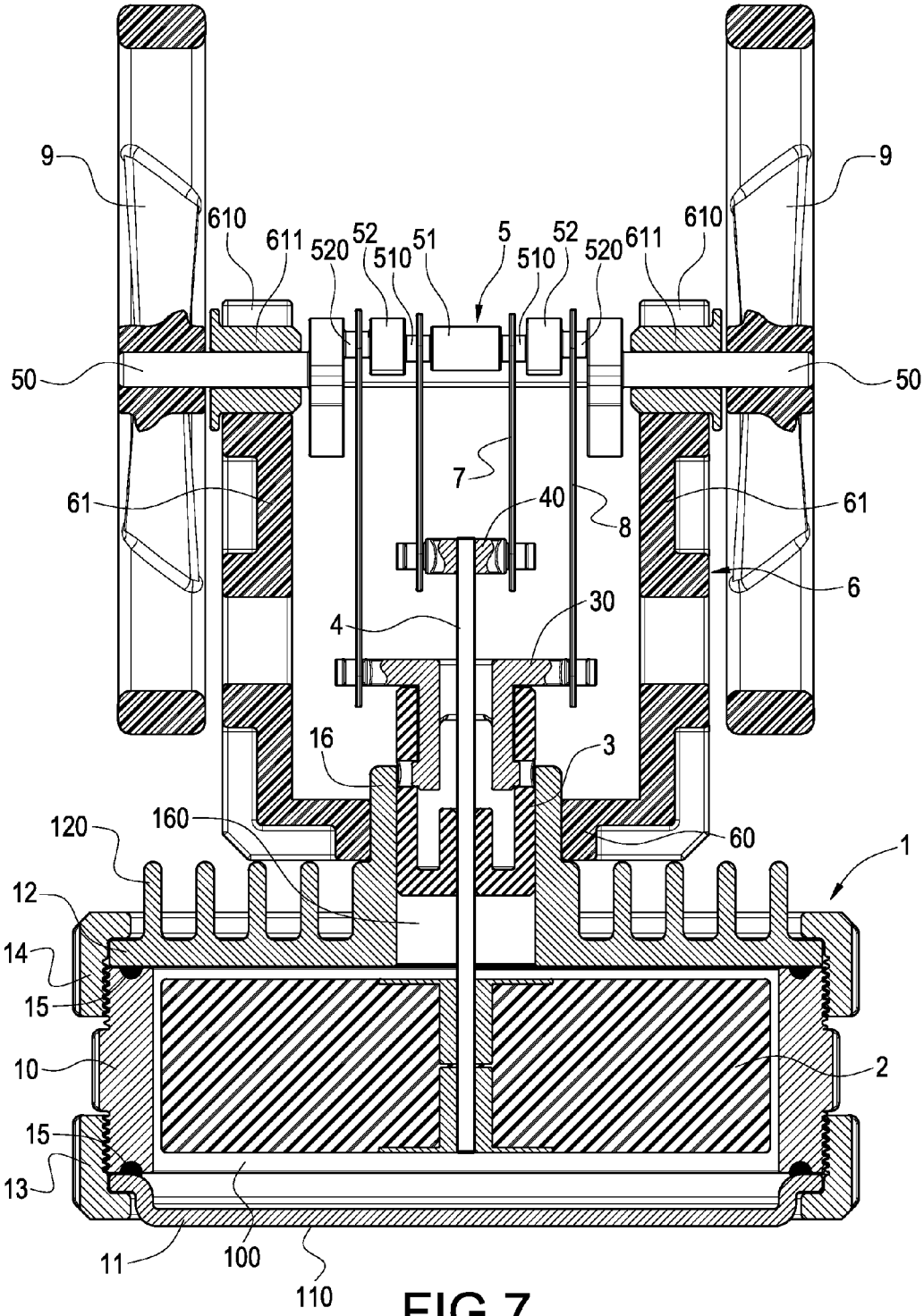
FIG. 7 is a plane sectional view of the second preferable embodiment according to the present invention.
Figure 8:
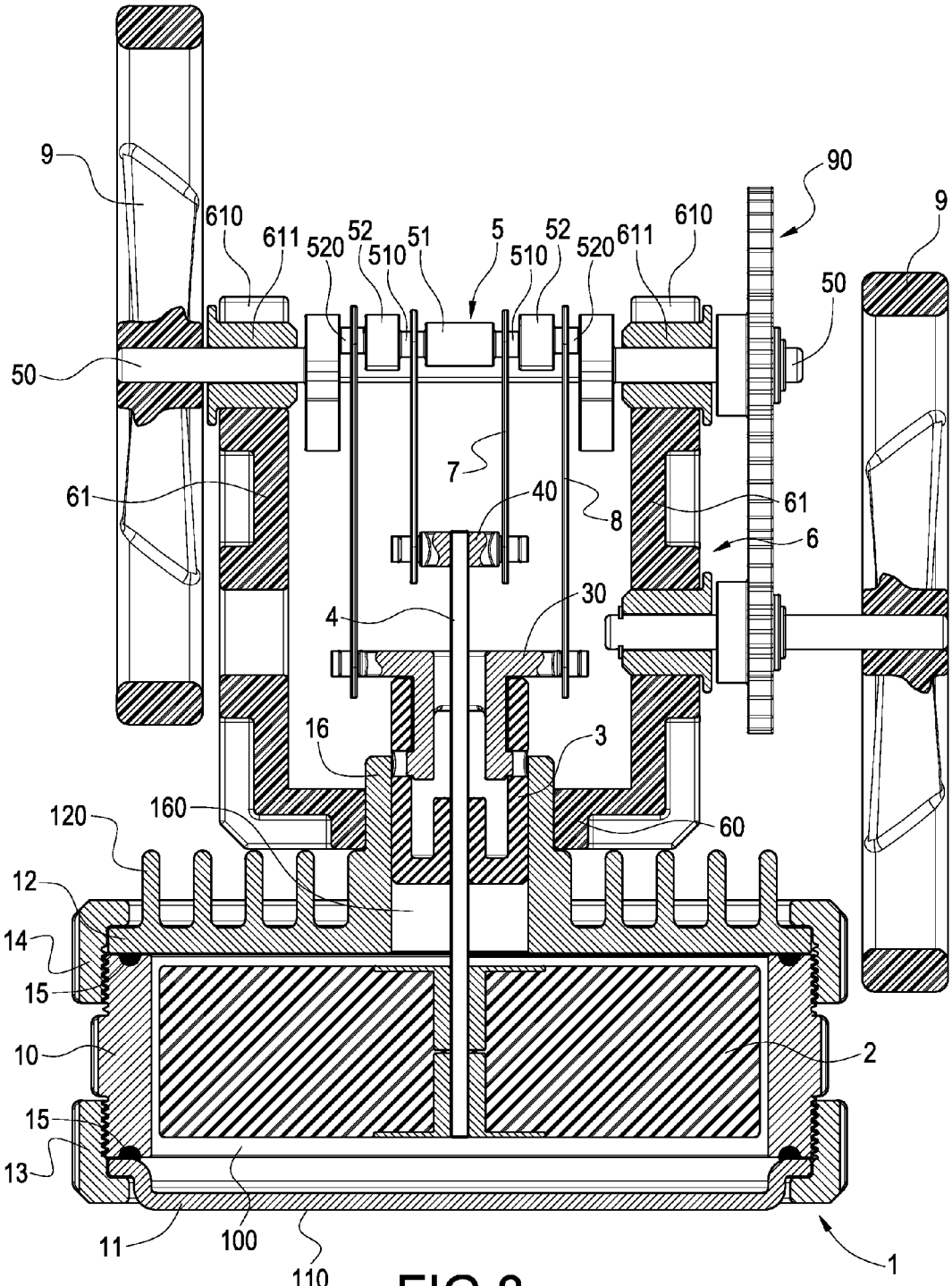
FIG. 8 is a plane sectional view of the third preferable embodiment according to the present invention.

Following the aforementioned description, where a crankshaft 5 may be driven to move by a Stirling engine according to the invention, a fan wheel 9 acted as a finally driven member can further be connected to a projected end of one of the pivot ends 50 of the crankshaft 5. Or, as shown in FIG. 7, two fan wheels 9 may be respectively connected to each projected end of two pivot ends of the crankshaft 5. Even, as shown in FIG. 8, a gear set 90 can be further applied to rotate a fan wheel 9. Aforementioned cases are only various applications and embodiments according to the invention.

Summarizing aforementioned description, the invention is a novel structure for Stirling engine indeed, which may positively reach the expected usage objective for solving the drawbacks of the prior arts, and which extremely possesses the innovation and progressiveness to completely fulfill the applying merits of new type patent, according to which the invention is thereby applied. Please examine the application carefully and grant it as a formal patent for protecting the rights of the inventor.

However, the aforementioned description is only a number of preferable embodiments according to the present invention, being not used to limit the patent scope of the invention, so equivalently structural variation made to the contents of the present invention, for example, description and drawings, is all covered by the claims claimed thereinafter.

What is claimed is:

1. A double power Stirling engine, including:

a piston seat, in which a hollow chamber is formed, and on which a piston tube is arranged and internally has an airtight passage communicated to the chamber; including a hollow main body, a bottom plate, and a top plate, wherein there are sealing washers arranged between the main body and the bottom and top plates;

a displacer, which is arranged in the chamber;

an airtight piston, which is arranged in the airtight passage; and a push rod, one side of which is connected to the displacer, and another side of which freely passes through the airtight piston and is extended out of the piston seat;

whereby a double power output is obtained via the airtight piston and the push rod.

2. The double power Stirling engine according to claim 1, wherein a heated face is arranged under the bottom plate, and wherein a plurality of cooling fins arranged on the top plate are extended outwardly.

3. The double power Stirling engine according to claim 1, wherein the piston seat further includes two ringed lids respectively covering the bottom and top plates.

4. The double power Stirling engine according to claim 3, wherein the two ringed lids are respectively bolted to the bottom and top plates.

5. A coaxial Stirling power mechanism, including:

a Stirling engine, which includes a piston seat having a hollow chamber therein, a displacer arranged in the chamber, an airtight piston, a push rod, and a piston tube arranged on the piston seat and internally having an airtight passage communicated to the chamber, the airtight piston being arranged in the airtight passage, one side of the push rod being connected to the displacer, while another side freely passing through the airtight piston and being extended out of the piston seat;

a crankshaft, which includes two coaxial pivot ends, a connecting rod located between the two pivot ends and configured eccentrically, two cranks respectively arranged between the connecting rod and the two pivot ends, two first pivoting parts respectively arranged between the connecting rod and the two cranks, and two second pivoting parts respectively arranged between the two cranks and the two pivot ends, the two pairs of the first and second pivoting parts being arranged eccentrically with respect to the two pivot ends;

an axial seat, which is pivoted to the two pivot ends of the crankshaft for placing the crankshaft onto the piston seat horizontally;

two first swing arms, which are respectively arranged between the push rod and the two first pivoting parts; and two second swing arms, which are respectively arranged between the airtight piston and the two second pivoting parts;

wherein each pair of the first and second swing arms is arranged symmetrically.

6. The coaxial Stirling power mechanism according to claim 5, wherein the piston seat of the Stirling engine includes a hollow main body, a bottom plate, and a top plate, and wherein there are sealing washers arranged between the main body and the bottom and top plates.

7. The coaxial Stirling power mechanism according to claim 6, wherein a heated face is arranged under the bottom plate, and wherein a plurality of cooling fins arranged on the top plate are extended outwardly.

8. The coaxial Stirling power mechanism according to claim 6, wherein the piston seat further includes two ringed lids respectively covering the bottom and top plates.

9. The coaxial Stirling power mechanism according to claim 8, wherein the two ringed lids are respectively bolted to the bottom and top plates.

10. The coaxial Stirling power mechanism according to claim 6, wherein a first pivoting seat is arranged at a top end of the push rod of the Stirling engine, while a second pivoting seat is arranged at a top end of the airtight piston, and the two first swing arms are respectively arranged between the first pivoting seat and the two first pivoting parts, while the two second swing arms are respectively arranged between the second pivoting seat and the two second pivoting parts.

11. The coaxial Stirling power mechanism according to claim 5, wherein the axial seat has a ringed bottom, from two corresponding ends of which two arms are respectively extended, and which is fitted onto the piston tube of the Stirling engine, and wherein two bearing parts are respectively formed at two top ends of the arms, while two axial sleeves are respectively arranged in the two bearing parts for pivoting the two pivot ends of the crankshaft.

* * * * *